US005634402A

United States Patent [19]

Rudd et al.

[11] Patent Number: 5,634,402

[45] Date of Patent: Jun. 3, 1997

[54] COATING HEATER SYSTEM

[75] Inventors: Paul D. Rudd, Minneapolis; Bruce E. Bailey, Burnsville, both of Minn.

[73] Assignee: Research, Incorporated, Eden Prairie, Minn.

[21] Appl. No.: 542,362

[22] Filed: Oct. 12, 1995

[51] Int. Cl.[6] ..... B41F 35/00

[52] U.S. Cl. ..... 101/424.1; 34/266; 34/267; 34/273; 34/274; 34/278; 34/629

[58] Field of Search ..... 101/424.1, 487, 101/488, 416.1; 34/266, 267, 273, 274, 278, 611, 618, 623, 629

[56] References Cited

U.S. PATENT DOCUMENTS

| | | | |
|---|---|---|---|
| 2,000,684 | 5/1935 | Allen et al. | 101/424.1 |
| 2,157,388 | 5/1939 | MacArthur | 101/424.1 |
| 2,565,570 | 8/1951 | Messinger | 101/424.1 |
| 2,578,633 | 12/1951 | Mauffre | 101/416.1 |
| 2,703,224 | 3/1955 | Robinson | 101/424.1 |
| 3,159,464 | 12/1964 | Early et al. | 101/416.1 |
| 4,474,552 | 10/1984 | Smith | 431/328 |
| 4,501,072 | 2/1985 | Jacobi, Jr. et al. | 34/1 |
| 4,698,767 | 10/1987 | Wensel et al. | 364/471 |
| 4,716,658 | 1/1988 | Jacobi, Jr. | 101/416.1 |
| 4,727,655 | 3/1988 | Jacobi, Jr. | 34/4 |
| 4,882,992 | 11/1989 | Schmoeger | 101/424.1 |
| 5,094,010 | 3/1992 | Jacobi et al. | 34/1 R |
| 5,321,595 | 6/1994 | Jacobi et al. | 362/373 |
| 5,379,697 | 1/1995 | Erdl | 101/424.1 |

FOREIGN PATENT DOCUMENTS

| | | | |
|---|---|---|---|
| 613960 | 2/1961 | Canada | 101/424.1 |
| 0213855 | 3/1987 | European Pat. Off. | 101/416.1 |
| 2073390 | 10/1981 | United Kingdom | 101/424.1 |
| 2142874 | 1/1985 | United Kingdom | 101/424.1 |

OTHER PUBLICATIONS

Comco–Flexopack, Water Base Flexopack, Pushing Technology by Breaking Tradition. (undated).

Amjo Infra–Red and Ultra–Violet Curing Systems Web Fed Presses, Wash. D.C. Paper Converting Convention, Sep. 30, 1987 Brochure 4 p.

*Primary Examiner*—Eugene H. Eickholt

*Attorney, Agent, or Firm*—Kinney & Lange, P.A.

[57] ABSTRACT

A system for applying heat to wet coatings applied to selected areas on a front surface of a continuous substrate includes an energy emitter for applying energy to the substrate to heat the substrate, a metallic roll contacting a back surface of the substrate opposite the front surface being heated, a mechanism for advancing the continuous substrate over and around the metallic roll and a contact member having a surface engaging the surface of the substrate. The metallic roll conducts heat away from non-selected areas on the substrate while the substrate is heated to prevent overheating of the non-selected areas. The contact member engages a surface of the substrate so that the substrate is in contact with greater than 180° of the metallic roll.

19 Claims, 3 Drawing Sheets

66
142
140
18
144
148
62
60
70
64
150
18
144
142
68

COATING HEATER SYSTEM

BACKGROUND OF THE INVENTION

The present invention relates to heating systems for directing energy to coatings applied to a substrate. In particular, the invention relates a drying system for drying or curing wet coatings such as printing inks, paint, sealants, etc. in which the coatings are applied to selected areas on the substrate and a conductor conducts heat away from non-selected areas on the substrate while the substrate is heated to prevent overheating of the non-selected areas.

Coatings, such as printing inks, are commonly applied to substrates such as paper, foil or polymers. Because the coatings often are applied in a liquid form to the substrate, the coating must be dried while on the substrate. Drying the liquid coatings is typically performed by either liquid vaporization or radiation-induced polymerization depending upon the characteristics of the coating applied to the substrate.

Water or solvent based coatings are typically dried using liquid vaporization. Drying the wet water-based or solvent-based coatings on the substrate requires converting the base of the coating, either a water or a solvent, into a vapor and removing the vapor latent air from the area adjacent the substrate. For the base within the coatings to be converted to a vapor state, the coatings must absorb energy. The rate at which the state change occurs and hence the speed at which the coating is dried upon the substrate depends on the pressure and rate at which energy can be absorbed by the coating. Because it is generally impractical to increase drying speeds by decreasing pressure, increasing the drying speed requires that the rate at which energy is absorbed by the coating be increased.

Liquid vaporization dryers typically use convection, radiation or a combination of the two to apply energy to the coating and the substrate to dry the coating on the substrate. With convection heating, the air is heated to a desired temperature and blown onto the coating and the substrate. The amount of heat transferred to the substrate and coating is dependent upon both the velocity and angle of the air being blown onto the substrate and the temperature difference between the air and substrate. At a higher velocity and a more perpendicular angle of attack, the air blown onto the substrate will transfer a greater amount of heat to the substrate. Moreover, the amount of heat transferred to the substrate will also increase as the temperature difference between the air and the substrate increases. However, once the substrate obtains a temperature equal to that of the temperature of the air, heat transfer terminates. In other words, the substrate will not get hotter than the air. Thus, the temperature of the air being heated can be limited to a level that is safe for the substrate. Although controllable, convection heating is thermally inefficient because air as well as nitrogen have very low heat capacities. Consequently, high volumes of flow are required to transfer heat.

Radiation heating occurs when two objects at different temperatures are in sight or view of one another. In contrast to convection heating, radiation heating transfers heat by electromagnetic waves. The quantity of energy emitted and the wavelength of the emission are both dependent upon the absolute temperature of the source. As the temperature of the source increases, heat transfer increases exponentially to the fourth power. Increasing source temperature results in shorter wavelengths, while decreasing source temperature results in longer wavelengths. Because radiation heating does not require a medium such as air to transfer heat, radiation heating is fast, powerful and efficient.

However, in contrast to convection heating, the rate of heat transfer is dependent upon the absorptivity of the target, i.e., the rate at which the substrate and coating absorb the electromagnetic waves emitted by the source of radiation. As a result, radiation heating often results in uneven, non-uniform heating of the substrate. Portions of the substrate having greater absorptivity will receive energy and heat up at a faster rate than portions of the substrate having lower absorptivity. For example, dark and rough areas on the substrate have higher rates of absorptivity than light colored or generally reflective, shiny portions. Thus, the dark and rough areas will absorb heat at a higher rate. When radiation is directed at the substrate at high intensities in order to dry or cure the coating more quickly, areas on the substrate which are dry or those areas which are dark or rough may burn or discolor. At the same time, other portions of the substrate which are light colored or smooth may still require additional heat to cure or dry the coating. Although efficient, radiation heating results in either excessive heating where portions of the substrate may be burned or discolored or underheating where the wet coating is not sufficiently dried or cured, resulting in offsetting of the wet coating on adjacent surfaces which come in contact with the wet coating.

Most liquid vaporization dryer systems employ both convection heating and radiation heating. However, most dryer systems also suffer from the inefficiency of convection heating and the non-uniform heating of radiation heating.

Because liquid vaporization is a "hot process" which requires heating of both the substrate and the coatings applied to the substrate to evaporate the base of the coating, the substrate exiting the dryer is often at an elevated temperature of around 240° F. Where the substrate comprises a web of material, the elevated temperature of the web presents a dangerous situation. As a result, typical liquid vaporization drying systems cool the web of the substrate after drying by blowing cool air over the substrate or by running the web of substrate through a series of chill rolls containing liquid coolant. The chill rolls are typically metallic cylinders which contact the substrate and which cool the substrate down to safe temperature levels.

Because radiation-induced polymerization does not require vaporization of the base of the coating, ultraviolet radiation employed by radiation-induced polymerization does not heat the substrate or its coatings. Consequently, radiation induced polymerization is generally considered a "cool process".

In contrast to liquid vaporization, radiation-induced polymerization is only generally suitable for specialized coatings. These coatings typically are composed of varnishes, waxes, dryers and other additives that carry the ink colorant (pigment), control the flow of the ink or varnish on the press and, after drying, bind the pigment to the substrate. The dryers include oligomers, which are partially polymerized molecules such as epoxy acrylates or acrylic esters that are blended with a reactive acrylate diluent. The dryers further include a photoinitiator to catalyze the reaction. During radiation-induced polymerization, ultraviolet or electron beam radiation causes polymerization or cross-linking within the liquid coatings. In other words, the liquid coating is polymerized to turn from a liquid to a solid. Little or no vapor is released by this process. In contrast to liquid vaporization, polymerization is virtually instantaneous. However, the high cost of oligomers and the reactive acrylate diluent restricts the use of such coatings and radiation-induced polymerization to specialty products.

SUMMARY OF THE INVENTION

The present invention is a system for applying heat to coatings applied to selected areas on a continuous substrate.

The system includes an energy emitter for applying energy to the substrate to heat the substrate, a metallic roll contacting a back surface of the substrate opposite the front surface being heated, a mechanism for advancing the continuous substrate over and around the metallic roll and a contact member having a surface for engaging a surface of the substrate. The metallic roll conducts heat away from non-selected areas on the substrate while the substrate is heated to prevent overheating of the non-selected areas. The contact member engages a surface of the substrate so that the substrate is contact with greater than 180° of the metallic roll. Because the contact member holds the substrate in contact with greater than 180° of the metallic roll, the metallic roll more effectively conducts heat away from non-selected areas on the substrate as the substrate is heated. In addition, the metallic roll more effectively conducts heat to selected areas on the continuous substrate to improve drying.

Preferred embodiments of the present invention additionally include an energy emitter which arcuately surrounds greater than 180° of the substrate in contact with the metallic roll. The energy emitter itself is preferably formed from a plurality of elongate heater components coupled to one another.

The method of the present invention is a method for printing upon a continuous substrate. The method includes applying a wet coating to a front surface of a portion of the continuous substrate, continuously advancing the portion of the continuous substrate over and around a metallic roll, engaging the continuous substrate so that the continuous substrate is in contact with greater than 180° of the metallic roll and applying energy to the continuous substrate in contact with the metallic roll to dry the wet coating on a portion of the continuous substrate as the portion advances over and around the metallic roll. Preferably, the method also includes heating the metallic roll to a temperature greater than the temperature of the continuous substrate prior to advancing the portion of the continuous substrate over and around the metallic roll. The temperature of the metallic roll is preferably adjusted based upon sensed temperature of the continuous substrate in contact with the metallic roll. In addition, the preferred method also includes adjusting a rate at which energy is applied to the continuous substrate in contact with the metallic roll based upon the sensed temperature of the substrate in contact with the metallic roll.

DETAILED DESCRIPTION OF THE PREFERRED EMBODIMENTS

Figure 1:
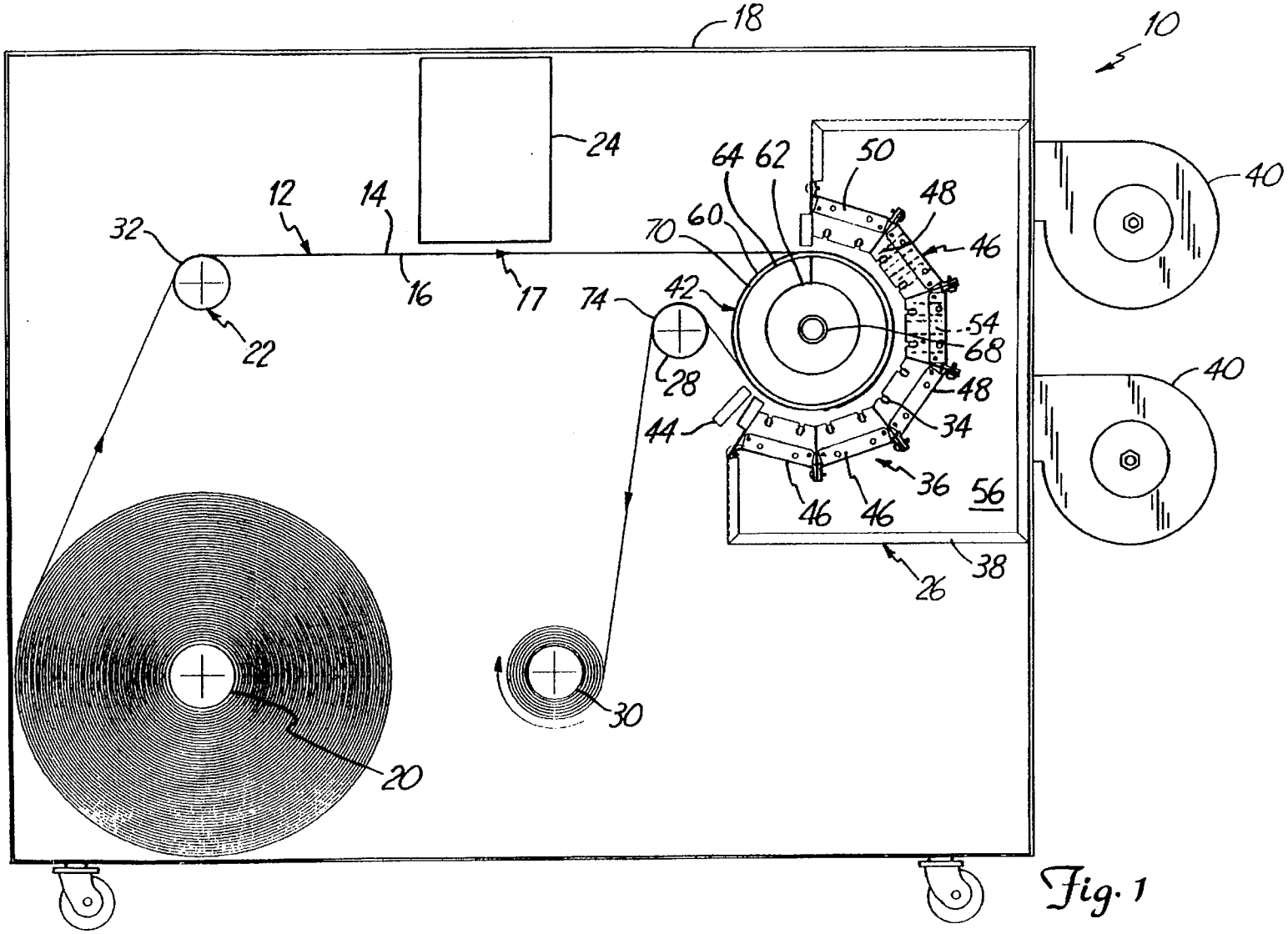
FIG. 1 is a cross-sectional view of a coating heater system including heater components which partially surround a thermal conductor.

FIG. 1 is a cross-sectional view of a coating heater system 10 for applying heat to coatings applied to selected areas on a substrate 12 having a front surface 14 and a back surface 16. Arrow heads 17 on substrate 12 indicate the direction in which substrate 12 is moved within coating heater system 10. System 10 generally includes enclosure 18, substrate supply roll 20, positioning roll 22, print head 24, dryer 26, positioning roll 28 and substrate take-up roll 30. Enclosure 18 is preferably made from steel and houses and encloses supply roll 20, positioning roll 22, print head 24, dryer 26, positioning roll 28 and take-up roll 30, as well as heater system drive and control systems (not shown). As can be appreciated, enclosure 18 may have a variety of sizes and configurations as necessary to support the components of dryer system 10.

Supply roll 20 is preferably cylindrical and provides a surface about which substrate 12 is stored and transported. Supply roll 20 is preferably rotatably mounted to enclosure 18 so that supply roll 20 may be rotated to permit substrate 12 to be unwound for printing and drying.

Positioning roll 22 is a cylindrically shaped roll. Positioning roll 22 is mounted to enclosure 18 above supply roll 20. Positioning roll 22 includes an arcuate surface 32 located at a preselected vertical distance from print head 22. Arcuate surface 32 engages back surface 16 of substrate 12 to stretch and position substrate 12 below print head 24. Positioning roll 22 is preferably rotatably coupled to enclosure 14 so that substrate 12 may be easily fed across printer head 24. As can be appreciated, positioning roll 22 may alternatively comprise any arcuate shaped member and may also be fixed to enclosure 18.

Printer head 24 is well-known in the art and applies liquid printing ink to front surface 14 of substrate 12. Printer head 24 is preferably mounted to enclosure 18 at a preselected distance above substrate 12. Printer head 24 applies wet coatings or print to selected portions or areas on front surface 14 of substrate 12. Typically, not selected portions on front surface 14 of substrate 12 are darker than the selected portions on front surface 14 of substrate 12 and do not have wet coatings applied thereon. In the depicted embodiment, the wet coatings are preferably water or solvent-base coatings which are dried using liquid vaporization. Because the coating applied to selected areas is wet, the coating must be dried before being taken up by take-up roll 30 to prevent smearing or offsetting of the coating on portions of the substrate or other members or materials coming into contact with the selected areas of the substrate.

Dryer 26 dries the ink applied by printer head 24 on substrate 12 and includes radiant energy emitters 34, housing 36, plenum 38, blowers 40, thermal conductor 42 and sensor 44. Radiant energy emitters 34 are preferably tubular lamps which emit radiant energy having selected wave lengths within the electromagnetic radiation spectrum. In the depicted embodiment, radiant energy emitters 34 comprise tubular quartz infrared lamps, as are well-known, having tungsten wire filaments that emit radiation energy in proportion to applied voltage. The tubular quartz infrared lamps emit energy in the infrared region or zone which includes wavelengths from 0.72 microns to 1 mm. At rated voltage, the lamps emit a peak wavelength of approximately 1.15 microns. Alternatively, radiant energy emitters 34 may comprise any one of many well-known radiant energy sources such as quartz tube heaters, metal rod sheet heaters and ultraviolet heaters which emit radiation having a variety of different wavelengths and radiant energy levels.

Radiant energy emitters 34 are supported within an arcuate configuration around thermal conductor 42. Radiant energy emitters 34 are preferably spaced from one another to provide uniform heat to substrate 12 which is wrapped around thermal conductor 42. The arc formed by radiant energy emitters 34 preferably surrounds or encloses approximately 230 degrees of thermal conductor 42 and substrate 12. As a result, radiant energy from radiant energy emitters 34 is more directly and uniformly applied to substrate 12. In addition, dryer 26 dries a larger area of substrate 14 at once and consumes less space. In the depicted embodiment, radiant energy emitters 34 are arcuately supported about thermal conductor 42 by housing 36.

Figure 2:
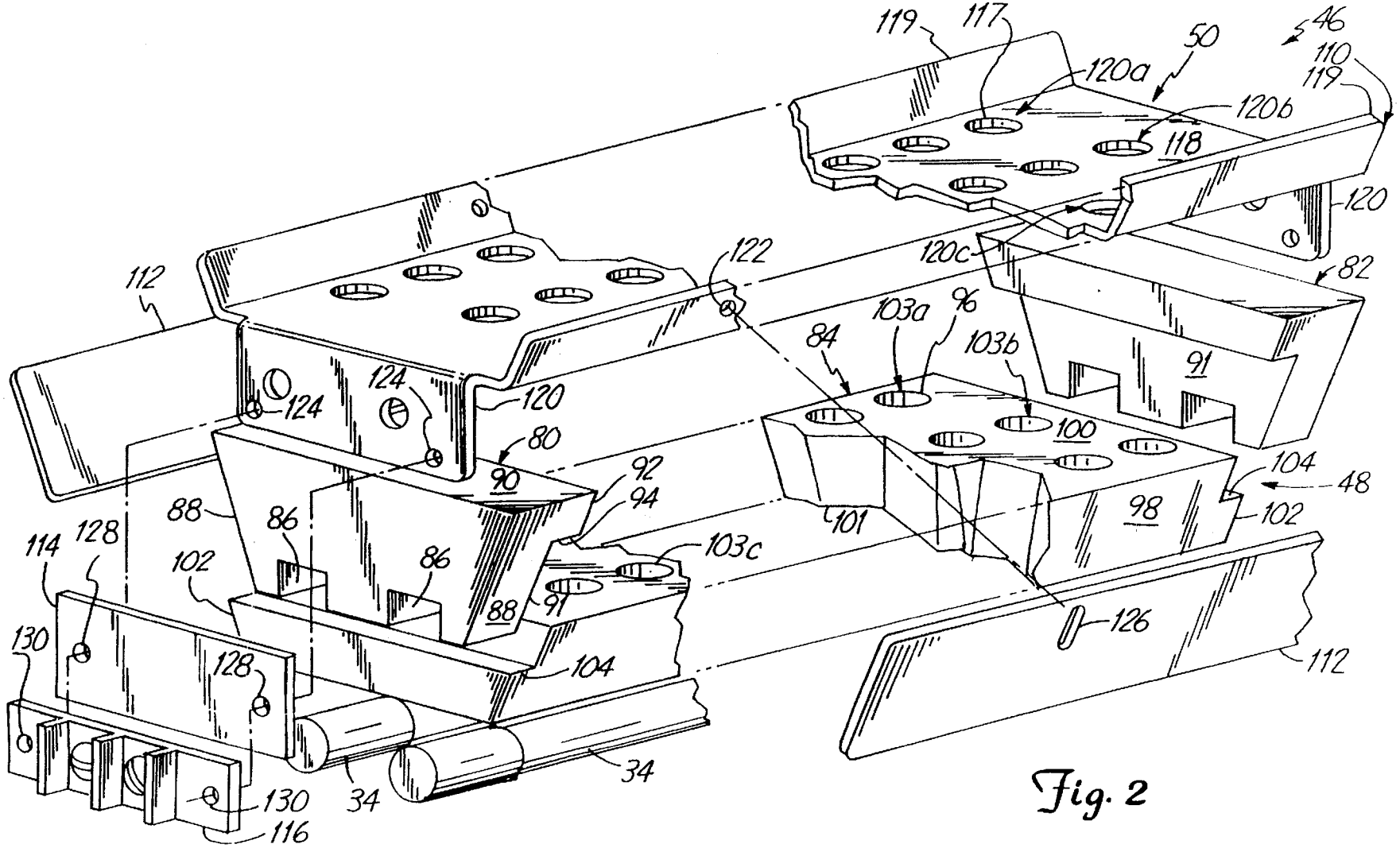
FIG. 2 is an exploded fragmentary perspective view of a heater component of the heater system of FIG. 1.

Housing 36 supports radiant energy emitters 34 and includes a plurality of heater components 46 (see FIGS. 1 and 2). Each heater component 46 is a generally elongate member having a trapezoidal cross-section. Heater components 46 are mounted to one another to form housing 36 which arcuately surrounds thermal conductor 42 for greater than 180 degrees. As can be appreciated, housing 36 may alternatively be formed from a single arcuate shaped member. Because housing 36 formed by heater components 46 and energy emitters 34 arcuately surround thermal conductor 42 and substrate 12 for greater than 180 degrees, substrate 12 is exposed to energy from housing 36 for a longer period of time. As a result, substrate 12 is dried more quickly and coating heater system 10 may be operated at higher speeds for a larger throughput.

Each heater component 46 supports radiant energy emitters 34 and includes reflectors 48, retainer 50 and vent passages 54. Reflector 48 is an elongate bar of reflective material. Reflector 48 is preferably made a ceramic fiberboard such as HP BOARD supplied by Thermal Ceramics of Augusta, Ga. The ceramic fiberboard additionally provides insulation and prevents the escape of radiation and generated heat from around thermal conductor 42 and substrate 12. Reflector 48 surrounds and encloses radiation emitters 34 to direct the emitted radiation uniformly over front surface 14 of substrate 12. Each reflector 48 is supported and maintained in its arcuate position by retainer 50.

Each retainer 50 is a generally elongate rigid plate abutting and partially enclosing reflector 48. Each retainer 50 is mounted to an adjacent retainer 50 so that heater components 46 may be mounted to one another to form housing 36. In the depicted embodiment, retainer 50 is made from a rigid material such as aluminum and insulating micaboard. Retainer 50 supports and orients reflector 48 and radiation emitters 34 of each heater component 46. The retainers 50 are mounted to and supported by plenum 38 of dryer 26.

Vent passages 54 extend through reflector 48 and retainer 50 to provide communication between the chamber 56 defined by plenum 38 and thermal conductor 42 supporting substrate 12. In the preferred embodiment, each heater component 46 supports two radiation emitters 34. Vent passages 54 are located and oriented in three longitudinal rows with one row positioned between radiation emitters 34 and two rows positioned on the left and right sides of radiation emitters 34. Vent passages 54 preferably extend through reflector 48 and retainer 50 at angles and locations such that a uniform air flow can be directed through vent passages 54 at the front surface 14 of substrate 12. Because vent passages 54 extend through reflector 48 which is preferably made from M-BOARD, the air passing through vent passages 54 is dried and heated as it contacts the M-BOARD, which heats up from radiation emitted by radiation emitters 34.

Plenum 38 is formed by several walls which surround and enclose housing 36. Plenum 38 is preferably mounted to walls of enclosure 18 adjacent blowers 40. Plenum 38 prevents the escape of air from blowers 40 such that the air is directed through vent openings 54 towards thermal conductor 42 and substrate 12.

Blowers 40 are well-known and are mounted to enclosure 18 so as to supply air through openings within enclosure 18 into plenum 38 through vent passages 54 at the front surface 14 of substrate 12. Air within plenum 38 cools heater components 46 and receives any energy or heat which has escaped from housing 36. In addition, the air is further heated as it passes through vent passages 54 and contacts reflectors 48. As a result, air directed at thermal conductor 42 and substrate 12 is dry and heated so as to further aid in drying coatings upon substrate 12. As can be appreciated, the air supplied to blowers 40 may be additionally heated by separate heating means distinct from the heat generated by radiation emitters 34.

Figure 3:
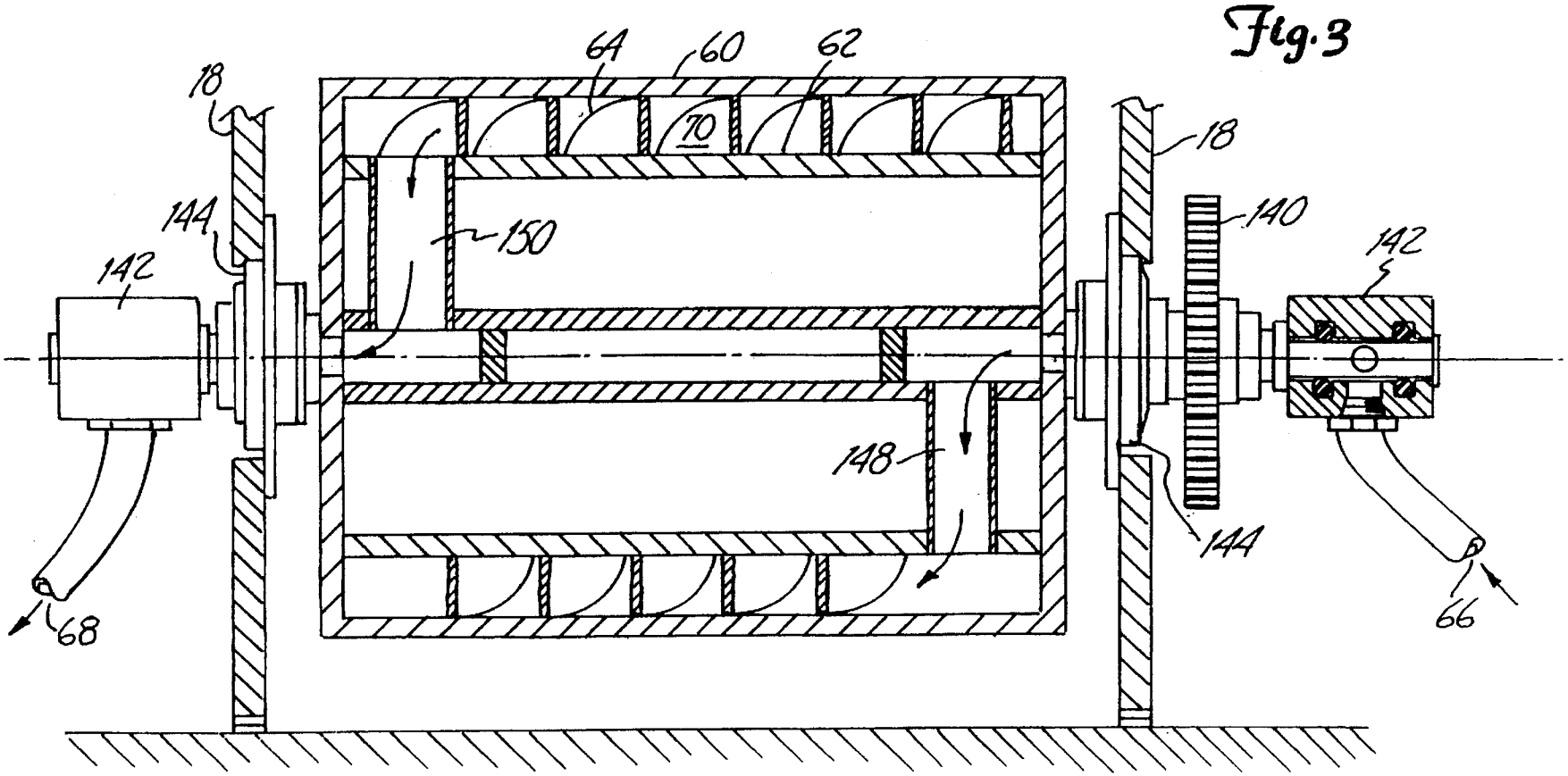
FIG. 3 is a sectional view of the thermal conductor of FIG. 1 in greater detail.

Thermal conductor 42 is a thermally conductive member which contacts back surface 16 of substrate 12 opposite front surface 14 of substrate 12 being radiantly heated. Although the preferred embodiment of thermal conductor 42 is depicted as having a single arcuate surface, thermal conductor 42 may alternatively be formed from several individual members which arcuately support and contact back surface 16 of substrate 12 while substrate 12 is being heated and dried by dryer 26. As best shown by FIG. 3, thermal conductor 42 includes cylinder or roll 60, interior drum 62, vanes 64, inlet 66, outlet 68, drive gear 140, rotating unions 142 and bearing assemblies 144.

As shown by FIG. 3, roll 60 is an elongate cylindrical drum having an interior 70 which contains drum 62, vanes 64, inlet 66, outlet 68 and conduit 140. Roll 60 is preferably formed from a material having a high degree of thermal conductivity such as metal. In the preferred embodiment, roll 60 is made from aluminum. Roll 60 preferably has a thickness of about ⅜ of an inch. The outer surface of roll 60 contacts the entire back surface 16 of the portion of substrate 12 being heated by heater 36. Because roll 60 is formed from a material having a high degree of thermal conductivity, roll 60 acts as a heat sink and conducts excess heat away from areas on the front surface 14 of substrate 12 which do not carry wet coatings such as inks. As a result, the areas of substrate 12 not containing wet coatings do not burn from being overheated by heater 36. At the same time, because roll 60 is also in contact with areas on the front surface of 14 of substrate 12 containing wet coatings such as inks, roll 60 conducts the excess heat back into these areas so that the wet coatings applied to the selected areas of substrate 12 dry in less time.

Roll 60 is rotatably mounted to enclosure 18 so that a top surface of roll 60 is at substantially the same horizontal level as arcuate surface 32 of positioning roll 22. Roll 60 cooperates with positioning roll 22 to support and stretch substrate 12 at a selected vertical spacing from printer head 24. Roll 60 also arcuately supports substrate 12 within heater 36 at an optimal spacing from radiation emitters 34 and reflectors 48 of housing 36.

Interior drum 62 is cylindrical and extends substantially along the entire length of roll 60. Drum 62 is coupled to roll 60 so that drum 62 rotates upon rotation of drum 60. Drum 62 carries vanes 64.

Vanes 64 spirally extend around drum 62 between drum 62 and roll 60. Vanes 64 circulate a liquid or fluid between roll 60 and drum 62 along the longitudinal length of roll 60. As a result, the liquid or fluid circulated adjacent to roll 60 conducts excess heat from one portion of roll 60 to another portion of roll 60 to transfer excess heat from one portion of the substrate to a portion of the substrate being dried. In addition, vanes 64 also circulate the fluid so as to regulate or control the temperature of roll 60 and the substrate wrapped around it.

As further shown by FIG. 3, thermal conductor 42 is rotatably sealed and supported to enclosure 18 by rotating unions 142 and bearing assemblies 144 so that thermal conductor 42 may be rotated by rotation of drive gear 140 by a conventional motor (not shown). Rotating unions 142 and bearing assemblies 144 are conventionally known. Rotating unions 142 provide a sealed path for the water and allows roll 60 to rotate freely. Bearing assemblies rotatably support thermal conductor 42 at opposite ends of enclosure 18. Rotating unions 142 and bearing assembly 144 permit thermal conductor 42 to be rotated as substrate 12 (shown in FIG. 1) traverses roll 60. Rotating unions 142 preferably comprises a single passage rotating union which is mounted between enclosure 18 and roll 60. Rotating unions 142 are in fluid communication with fluid passages 148, 150 that are in communication with interior 70 of roll 60. Rotating union 142 also rotatably couples thermal conductor 42 to enclosure 18 so that thermal conductor 42 may be rotated as substrate 12 (as shown in FIG. 1) traverses roll 60. Fluid enters interior 70 through fluid passage 148. Circulated fluid exits or leaves interior 70 through fluid passage 150.

In operation, liquid coolant or fluid is supplied through inlet 66 and is directed longitudinally along and around drum 62 between drum 62 and roll 60 by vanes 64. As a result, liquid coolant or fluid having a selected temperature is circulated adjacent to roll 60 at the selected rate so as to control or regulate the temperature of roll 60 as well as substrate 12 in contact with roll 60 to prevent burning or discoloration of substrate 12 caused by overheating portions of substrate 12. The liquid coolant or fluid further conducts excess heat away from areas of substrate 12 which do not carry coatings or which carry coatings which have already dried to areas of substrate 12 still carrying wet coatings. Consequently, wet coatings applied to substrate 12 may be more quickly and efficiently dried.

Once fluid has circulated along substantially the entire longitudinal length of roll 60, fluid exits through outlet 68. As a result, fluid may be continuously circulated into interior 70 of roll 60 through inlet 66. Because drum 62 rotates in conjunction with roll 60, the fluid is circulated adjacent roll 60 along the entire longitudinal length of roll 60 by vanes 64. Once the fluid has been circulated along the entire length of roll 60, fluid exits through outlet 68 and is taken out of enclosure 18. Consequently, a continuous supply of temperature regulated fluid may be supplied to and circulated within roll 60.

Sensor 44 comprises any one of a variety of well-known temperature sensors including optical temperature sensors or thermocouples. Sensor 44 preferably is a non-contact infrared sensor. Sensor 44 is mounted to enclosure 18 adjacent to the end of housing 36. Alternatively, sensor 44 may be placed at a variety of locations adjacent to or within dryer 26 for measuring the temperature of substrate 12. Sensor 44 senses and measures the temperature of substrate 12 as substrate 12 is exiting housing 36 of dryer 26. Sensor 44 permits closed loop temperature control of substrate 12. As a result, radiation emitted by radiation emitters 34, the temperature and rate of the circulation fluid through interior 70 of roll 60, and the rate and temperature of air applied to substrate 12 through vent openings 54 may be controlled and adjusted to dry wet coatings applied to substrate 12 in the shortest amount of time without chafing, burning or discoloring substrate 12.

Positioning roll 28 (FIG. 1) is similar to positioning roll 22 and is preferably a metal cylinder. Positioning roll 28 is mounted to enclosure 18 above a lower surface of thermal conductor 42. Positioning roll 28 includes an arcuate surface 74 which engages front surface 14 of substrate 12 to stretch and wrap substrate 12 around roll 60 within dryer 26. Arcuate surface 74 of positioning roll 28 is preferably positioned so as to wrap substrate 12 around at least about 230 degrees of roll 60. Because positioning roll 28 stretches and maintains substrate 12 in close contact with roll 60, roll 60 is better able to conduct excess heat away from areas of substrate 12 to areas of substrate 12 that require further heating for sufficiently drying the wet coatings applied thereon. Furthermore, because positioning roll 28 enables substrate 12 to be wrapped around a large percentage of thermal conductor 42, a larger surface area of substrate 12 remains in contact with thermal conductor 42 and may be optimally heated by dryer 26. As a result, substrate 12 is exposed to energy from dryer 26 for a longer period of time. Consequently, system 10 dries substrate 12 more quickly so that system 10 may be operated at a higher throughput speed. For example, system 10 is capable of printing upon and drying substrate 12 at a rate of approximately 1,000 feet per minute.

Take-up roll 30 is a cylindrical tube rotatably mounted to enclosure 18 below positioning roll 28. Take-up roll 30 is rotated by motors or other welt-known rotational means (not shown) to collect substrate 12 after the wet coatings applied to substrate 12 by printer head 24 have been sufficiently dried. Take-up roll 30 is preferably releasable from enclosure 18 so that once a sufficient amount of substrate 12 has been collected by take-up roll 30, take-up roll 30 may be replaced with an empty take-up roll.

In operation, heating by heater 26 of system 10 is preferably initiated prior to the actuation of take-up roll 30 and printhead 24 to heat the fluid within thermal conductor 42 prior to any printing. Preferably, the fluid within thermal conductor 42 is heated to a temperature greater than at least 120 degrees Fahrenheit and preferably between 125 degrees and 130 degrees Fahrenheit. Once the fluid within thermal conductor 42 reaches the desired temperature, take-up roll 30 and printhead 24 are actuated to begin application of wet coatings to face 14 of substrate 12 and to take up substrate 12 once the wet coatings have been dried. Because the fluid within thermal conductor 42 is heated to an elevated temperature, thermal conductor 42 brings substrate 12 up to a desired temperature to facilitate faster drying of the wet coatings upon substrate 12.

FIG. 2 shows an exploded fragmentary perspective view of an individual heater component 46 which includes radiation emitters 34, reflector 48 and retainer 50. As best shown by FIG. 2, reflector 48 includes lamp locators 80, 82 and reflector back 84. Lamp locators 80, 82 are identical to one another and are preferably formed from HP BOARD supplied by Thermal Ceramics of Augusta, Georgia. Each locator 80, 82 is generally a trapezoidal shaped member which defines slots 86 and includes angled side edges 88, top surface 90, inner surface 91 and platform 92. Slots 86 are spaced from one another and extend into a lower surface of locator 80. Slots 86 are sized for the reception of radiation emitters 34 which preferably comprise tubular quartz lamps. Slots 86 receive and space apart radiation emitters 34 at a desired spacing so as to uniformly apply radiation to the underlying substrate.

Angle edges 88 which give locator its trapezoidal shape diverge outwardly away from one another towards top surface 90. In the preferred embodiment, angled edges 88 are at an angle of about 72 degrees with respect to top surface 90. Because edges 88 are angled, locators 80 and 82 are supported by retainer 50 without extensive use of screws or other mounting mechanisms. Platform 92 of each member 80, 82 projects outwardly towards the longitudinal center of reflector 48 to form a shoulder 94. Shoulder 94 engages reflector back 84 to securely position back 84 between locators 80 and 82 and to space back 84 from radiation emitters 34 received within slots 86.

Reflector back 84 is supported between locators 80, 82. Back 84 is a generally elongate horizontal member having a trapezoidal shaped cross-section. Back 84 is preferably formed from a reflective material with high heat resistance such as a ceramic fiberboard such as HP BOARD supplied by Thermal Ceramics of Augusta, Georgia. As can be appreciated, other reflective materials may be used in lieu of ceramic fiberboard. Back 84 defines lower vent apertures 96 and includes angled side edges 98, top surface 100, bottom surface 101 and lower platform 102. Vent apertures 96 extend through back 84 and are preferably positioned in three rows 103*a*, 103*b* and 103*c* along back 84. Rows 103*a*, 103*b* and 103*c* are spaced from one another so as to uniformly vent heated air across the underlying substrate. In the preferred embodiment, row 103*b* is centrally located across back 84 while rows 103*a*, 103*b*, and 103*c* are spaced approximately 1.37 inches apart.

Apertures 96 constitute a lower portion of vent passages 54 (shown in FIG. 1). Each aperture 96 has a diameter sized to allow sufficient venting of heated air to the underlying substrate while still maintaining sufficient reflection of radiation from radiation emitters 34. In the preferred embodiment, apertures 96 have diameters of 0.250 inches and centers which are spaced from centers of adjacent apertures in the same row by approximately 0.70 inches.

Angled edges 98 which give back 84 its trapezoidal cross-section diverge away from one another as edges 98 approach top surface 100. Edges 98 preferably have an angle with respect to the horizontal the same as the angle of edges 88 of members 80, 82. Because edges 88 and 98 are angled so as to widen towards top surfaces 90 and 100, respectively, lamp locators 80 and 82, and back 84 are supported by retainer 50 without extensive use of screws or other mounting mechanism extending into back 84. Consequently, the overall integrity of back 84 is not compromised. Moreover, because edges 88 and 98 widen towards top surfaces 90 and 100, respectively, each heater component 46, once assembled adjacent to other heater components, forms a segment of an arcuately shaped configuration for surrounding thermal conductor 42 (shown in FIG. 1).

Lower platform 102 projects outwardly away from opposite sides of back 84 to form lower shoulders 104. Lower shoulders 104 abut and engage upper shoulders 94 of members 80, 82 to securely support back 84 between members 80, 82 in a spaced apart relationship from radiation emitters 34.

Inner surfaces 91 of members 80, 82 and lower surface 101 of back 84 substantially surround and enclose radiation emitters 34 and provide a reflective surface for reflecting radiation emitted by radiation emitters 34 towards the underlying substrate. In addition, back 84 absorbs a percentage of energy radiated by radiation emitters 34, and thus emits radiation or electromagnetic waves having longer wavelengths. Back 84 also conducts heat around apertures 96 to heat air passing through apertures 96 towards the underlying substrate.

Retainer 50 supports and encloses reflector 48 and provides terminals for energizing radiation emitters 34. Retainer 50 includes reflector support 110, side retaining plates 112, insulator 114 and bus bar or terminal barrier strip 116. Reflector support 110 is an elongate rigid plate which defines vent apertures 117 and includes deck 118, wings 119 and end flanges 120. Vent apertures 117 extend through deck 118 and preferably have diameters at least the size of the diameters of vent apertures 96 through back 84. Vent apertures 117 preferably have diameters of 0.437 inches. Vent apertures 117 are located in three rows 120*a*, 120*b* and 120*c* which are in alignment with rows 103*a*, 103*b* and 103*c*, respectively, of back 84. As a result, vent apertures 117 are in alignment with vent apertures 96 of back 84 to form vent passages 54. Back 84 heats air flowing through vent apertures 117 before the air contacts the underlying substrate.

Deck 118 is a generally flat elongate sheet of rigid material having a width slightly larger than the width of terminal barrier strip 16. Upon assembly of heater component 46, deck 118 abuts top surface 90 of locators 80, 82 and top surface 100 of back 98 to rigidize and support reflector 48.

Wings 119 integrally project upward and outward from side edges of deck 118. Wings 118 preferably project upward and outward at an angle approximately equal to the angle of edges 88 and 98 of locators 80, 82 and back 84, respectively. In the preferred embodiment, wings 119 extend upward and outward at an angle of approximately 72 degrees with respect to the horizontal. Wings 119 include mounting holes 122 for receiving screws for mounting retaining plates 112 to wings 119 of reflector support 110. Wings 119 of reflector support 110 retaining plates 112 so as to hold retaining plates 112 into abutting contact with locators 80, 82 and back 84 to hold each heater component 46 together.

End flanges 118 preferably comprise flat plates which extend integrally and perpendicular from deck 118 at the longitudinal ends of support 110. Flanges 118 include mounting holes 124 for receiving attachment mechanisms (not shown) for mounting insulator 114 and terminal barrier strip 116 to flanges 120 of support 110.

Retaining plates 112 are generally elongate flat plates having a longitudinal length approximately equal to the longitudinal length of retainer support 110 and having a height positioned so that each plate 112 extends from wings 119 of reflector support 110 to the bottom of reflector back 84. Retainer plates 112 include mounting holes 126 for receiving screws (not shown) for mounting plates 112 to wings 119 of reflector support 110. Because retaining plates 112 are mounted to wings 119 which extend outward at an angle, the lower ends of retaining plates 112 are angled inward so as to converge towards one another. As a result, retaining plates 112 support and maintain reflector 48 between retaining plates 112.

Insulator 114 is a generally flat rectangular plate formed from an insulating material such as mica board. Insulator 114 includes mounting holes 128 which are preferably aligned with mounting holes 124 of flanges 120. Mounting holes 128 are sized for receiving attachment mechanisms such as bolts or screws (not shown) so that insulator 114 may be mounted to an outer surface of flange 120 of support 110. Insulator 114 is positioned between flange 118 and terminal barrier strip 116. Insulator 114 electrically insulates terminal barrier strip 116 from support 110 and reflector 82 to prevent electrical shorts between emitters 34 and retainer 50.

Terminal barrier strip 116 is conventionally known and includes mounting holes 130 which receive screws (not shown) so that barrier strip 116 may be mounted adjacent to insulator 114 and coupled to flanges 120. As conventionally known, terminal barrier strip 116 receives electrical wires or conduits from radiation emitters 34. Energy to radiation emitters 34 is supplied to terminal barrier strip 116 so that radiation emitters 34 may be powered to provide radiant energy directed at the underlying substrate.

As a result of its construction, each heater component 46 is a compact heating element easily and inexpensively manufactured. Each heater component 46 concurrently serves several purposes. First, each heater component 46 mounts and supports radiation emitters 34 above the substrate at a selected spacing to optimally irradiate the substrate. In addition, each heater component 46 reflects radiation towards the underlying substrate. The portion of the radiation absorbed by heater component 46 causes the heater component 46 to heat up and also emit radiation. The heat absorbed and emitted by heater component 46 is transferred to air passing through apertures 96 towards the underlying substrate. As a result, energy supplied by radiation emitters 34 is efficiently utilized to dry wet coatings applied to the underlying substrate. Because of the overall trapezoidal shape of each heater component 46, components 46 are mounted adjacent to one another to form a compact arcuately shaped heater for surrounding thermal conductor 42 shown in FIG. 1.

Thermal conductor 42 utilizes the energy efficiently supplied by heater components 46 to uniformly dry wet coatings applied to the substrate 12 (shown in FIG. 1) in less time and at a lower cost. Because roll 60 of thermal conductor 42 is formed from a material having a high degree of thermal conductivity, roll 60 acts as a heat sink and conducts excess heat away from areas on the front surface 14 of substrate 12 which do not carry wet coatings. Consequently, the areas of substrate 12 not containing wet coatings do not burn from being overheated. At the same time, because roll 60 is also in contact with areas on the front surface 14 of substrate 12 containing wet coatings, roll 60 also conducts the excess heat back into these areas so that the wet coatings applied to the selected areas of substrate 12 dry in less time. To further maintain uniform heating and to decrease drying time, thermal conductor 42 also circulates a liquid coolant or fluid having a selected temperature adjacent roll 60. The fluid regulates the temperature of roll 60 as well as substrate 12 in contact with roll 60 to prevent burning or discoloration of substrate 12 caused by overheating portions of substrate 12. The liquid coolant or fluid also conducts excess heat away from areas of substrate 12 which do not carry coatings or which carry coatings which have already been dried to areas of substrate 12 having a lower temperature or areas of substrate 12 still carrying wet coatings. As a result, thermal conductor 42 effectively utilizes the energy supplied by heater components 46 to uniformly dry coatings applied to substrate 12 in a minimum period of time. Overall, the present invention applies wet coatings or print to a substrate and dries the coatings or print on the substrate at a faster throughput speed with less power or energy consumption.

As can be appreciated, the dimensions and makeup of coating heater system 10 may be varied. For example, the size of roll 60 may be increased and the position of positioning roll 28 modified to further increase the degree at which substrate 12 is wrapped about roll 60 and to further increase the rate at which coatings upon substrate 12 are dried.

Although the present invention has been described with reference to preferred embodiments, workers skilled in the art will recognize that changes may be made in form and detail without departing from the spirit and scope of the invention.

What is claimed is:

1. A system for drying wet coatings applied to selected areas on a front surface of a continuous substrate by liquid vaporization, the system comprising:

an energy emitter for applying energy to the substrate to heat the substrate, the energy emitter including:

a plurality of infrared lamps arcuately surrounding a portion of the substrate, wherein the infrared lamps apply infrared energy to the substrate to heat the substrate and to dry the wet coatings, wherein darker and rougher areas of the substrate absorb the infrared energy at a higher rate than lighter and smoother areas;

a metallic roll contacting a back surface of the substrate opposite the front surface being heated, wherein the metallic roll conducts heat away from the darker and rougher areas of the substrate while the substrate is heated; and a liquid coolant circulating through the metallic roll, wherein the liquid coolant absorbs excess heat conducted through the roll from the darker and rougher areas while the substrate is heated to prevent overheating of the darker and rougher areas.

2. The system of claim 1 wherein the contact member comprises a positioning roll positioned within a radius of the metallic roll.

3. The system of claim 1 wherein the emitter for applying energy to the substrate includes:

a plurality of elongate heater components coupled to one another to arcuately surround the portion of the substrate in contact with the metallic roll, each heater component including:

an elongate bar of ceramic fiberboard defining a plurality of vent passages extending through the fiberboard, wherein at least one infra red lamp is supported between the metallic roll and the ceramic fiberboard so that radiation emitted by the infra red lamp is reflected by the ceramic fiberboard towards the front surface of the substrate; and a mechanism for directing air through the vent passages within the ceramic fiberboard so that the air is heated by the ceramic fiberboard and is directed at the front surface of the substrate.

4. The system of claim 3 wherein the plurality of elongate heater components arcuately surround greater than 180° of the substrate in contact with the metallic roll.

5. The system of claim 4 wherein the plurality of elongate heater components arcuately surround the substrate in contact with the metallic roll for about 230°.

6. The system of claim 1 including:

means for selectively controlling a temperature and flow rate of the liquid coolant.

7. The system of claim 1 including:

means for sensing the temperature of the substrate while the substrate is being heated; and means for adjusting the temperature of the liquid coolant based on the sensed temperature of the substrate.

8. The system of claim 1 wherein the emitter for applying energy further includes:

a source of hot, dry air.

9. The system of claim 8 wherein the infra-red lamps are supported in a housing above the substrate and wherein the source of hot, dry air includes air portholes defined through the housing so that air passing through the air portholes heats up and decreases in relative humidity for drying the wet coating as the air is applied to the substrate.

10. The system of claim 1 wherein the emitter for applying energy to the substrate to heat the substrate arcuately surround greater than 180° of the substrate in contact with the metallic roll.

11. A method for printing upon a continuous substrate, the method comprising:

applying a wet coating containing a base to selected areas on a front surface of a portion of the continuous substrate;

continuously advancing the portion of the continuous substrate over and around a metallic roll;

applying infrared energy to the continuous substrate in contact with the metallic roll to vaporize the base within the wet coating on the portion of the continuous substrate as the portion advances over and around the metallic roll, wherein darker and rougher areas of the substrate absorb the infrared energy at a higher rate than lighter and smoother areas; and circulating a liquid coolant through and within the metallic roll, wherein the liquid coolant absorbs excess heat conducted through the metallic roll from the darker and rougher areas to prevent overheating of the darker and rougher areas of the substrate.

12. The method claim 11 further including:

applying hot, dry air to the substrate to dry the wet coating applied to the continuous substrate.

13. The method of claim 11 including:

sensing a temperature of the substrate in contact with the metallic roll.

14. The method of claim 13 including:

adjusting a temperature of the liquid coolant based upon the sensed temperature of the continuous substrate in contact with the metallic roll.

15. The method of claim 13 including:

adjusting a rate at which energy is applied to the continuous substrate in contact with the metallic roll based upon the sensed temperature of the substrate in contact with the metallic roll.

16. A system for applying energy to wet coatings applied to selected areas on a front surface of a substrate, the system comprising:

a substrate support for supporting the substrate;

a source of radiant energy;

a housing adjacent the substrate supporting the source of radiant energy adjacent the substrate, the housing including a bar of ceramic fiberboard which supports the source of radiant energy so that radiation emitted by the source of radiant energy is reflected towards the substrate; and a source of hot, dry air, wherein the source of hot, dry air includes a plurality of vent passages extending through the bar of fiberboard so that air passing through the vent passages heats up and decreases in relative humidity for drying the wet coating as the air is applied to the substrate.

17. The system of claim 16 wherein substrate support includes a metallic roll and wherein the housing arcuately surrounds the portion of the substrate in contact with the metallic roll.

18. The system of claim 16 wherein the source of hot, dry air includes:

a plenum substantially enclosing the housing opposite the substrate; and means for pressurizing air within the plenum.

19. The system of claim 16 wherein the source of radiant energy includes:

a plurality of infra-red lamps.

* * * * *

UNITED STATES PATENT AND TRADEMARK OFFICE

CERTIFICATE OF CORRECTION

PATENT NO. : 5,634,402

DATED : JUNE 3, 1997

INVENTOR(S) : PAUL D. RUDD, BRUCE E. BAILEY

It is certified that error appears in the above-indentified patent and that said Letters Patent is hereby corrected as shown below:

Col. 8, line 21, delete "welt-known", insert --well-known--

Signed and Sealed this

Fourth Day of November, 1997

*Attest:*

*Attesting Officer*

BRUCE LEHMAN

*Commissioner of Patents and Trademarks*